United States Patent [19]

Stanton

[11] 4,149,285

[45] Apr. 17, 1979

[54] AIR SUPPORT MATTRESS

[76] Inventor: Austin N. Stanton, 4240 Briar Creek La., Dallas, Tex. 75214

[21] Appl. No.: 866,744

[22] Filed: Jan. 3, 1978

[51] Int. Cl.[2] ..... A47C 27/08

[52] U.S. Cl. ..... 5/347; 5/369

[58] Field of Search ..... 5/60, 347, 349, 350, 5/365, 369

[56] References Cited

U.S. PATENT DOCUMENTS

| | | | |
|---|---|---|---|
| 3,340,551 | 9/1967 | Hopkins | 5/347 |
| 3,354,476 | 11/1967 | Scales et al. | 5/347 |
| 3,740,777 | 6/1973 | Dee | 5/347 |
| 3,942,202 | 3/1976 | Chevorlet | 5/347 |

*Primary Examiner*—Casmir A. Nunberg

*Attorney, Agent, or Firm*—Richard A. Zacher

[57] ABSTRACT

An air support mattress includes elastic upper and lower main support walls interconnected by a multiplicity of ties to restrain separation of the walls by internal air pressure, the upper wall having inner and outer layers with patterns of perforations to provide controlled conformability and air stream flow to support a recumbent patient.

12 Claims, 7 Drawing Figures

FIG. 1
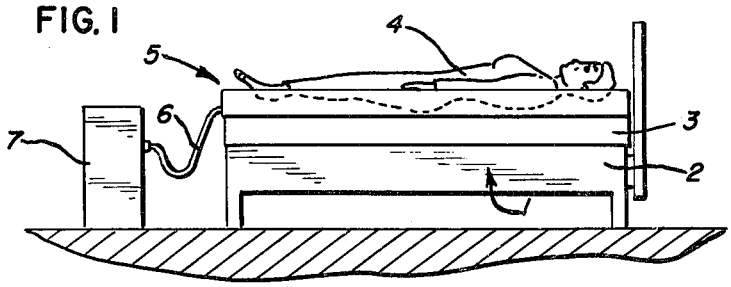
FIG. 2
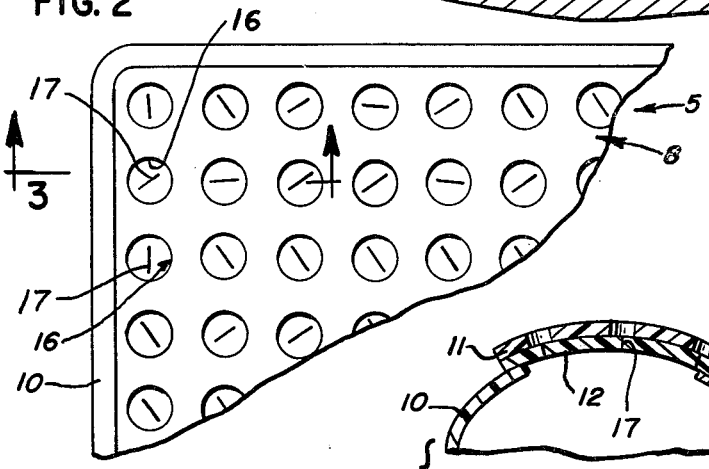
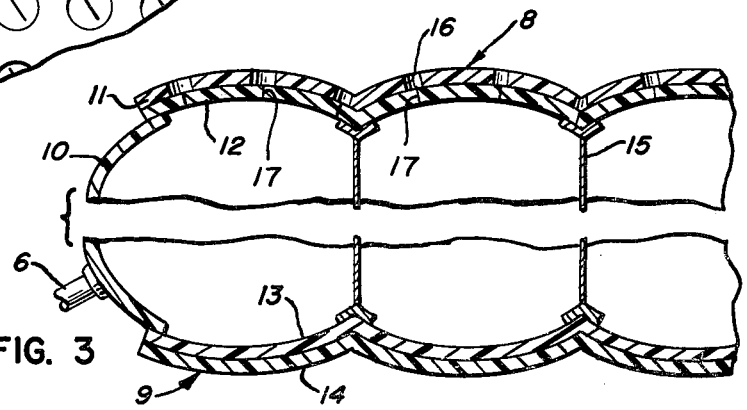
FIG. 3
FIG. 4
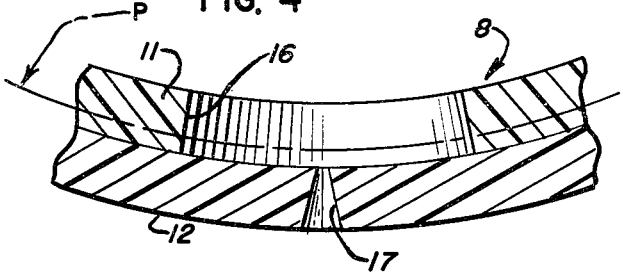
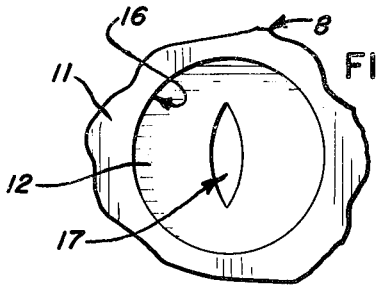
FIG. 5
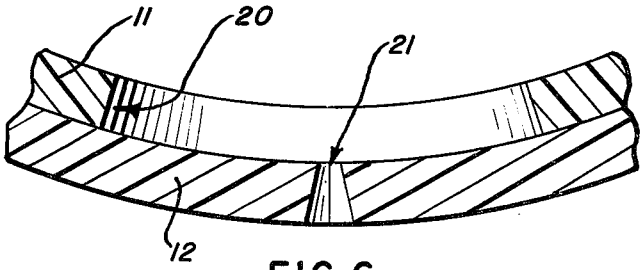
FIG. 6
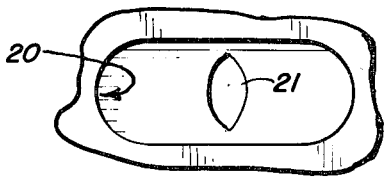
FIG. 7

AIR SUPPORT MATTRESS

BACKGROUND OF THE INVENTION

The present invention generally relates to mattresses and, more particularly, to improved air support mattresses and pads for use in the treatment and resuscitation of patents in hospitals, nursing homes and for home care. More specifically, the mattresses, of the present invention provide a cushion of air between the recumbent patient and the supporting mattress or pad, thereby eliminating possible contact therebetween.

Current types of mattresses are relatively non-conformable and cannot limit the pressure at supported body portions supporting to permit the desired free flow of blood and lymph.

It has long been felt desirable to eliminate contact between a patient's body and the suporting mattress, especially in the cases of patients with extensive burns and of patients with incipient decubitus. Living animals of a size comparable to that of humans have been supported for indefinite periods by a broad rising column of air. This method of support has not proved to be practical because the high velocity of the rising column required to support and position the animal tended to damage the healing areas by continual erosion. Further, the level of noise is excessive.

Various systems and devices have been suggested for supporting recumbent patients on a cushion of air. Such systems have incorporated expensive, complicated pressure regulation devices and have required constant adjustment. More recently, as disclosed in Chevrolet U.S. Pat. No. 3,942,202 there has been suggested the use of an elastomeric plate formed with a pressurizable passage connectable with an array of vents. Upon deformation of the plate the vents open into the passage to provide for air flow from the passage through the vents. Accordingly, deflection of the plate caused by the weight of a patient causes air flow from the vents which, according to the Chevrolet disclosure, takes over at least part of the supporting function of the mattress. This prior art device has a disadvantage in that it comprises a relatively thick sheet of rubber material that is quite unyielding to light pressure and unresponsive to small areas of contact.

SUMMARY OF THE INVENTION

The principal object of the present invention is to provide an air cushion that avoids the problems of the prior art and that is characterized in that very low air pressures are utilized to life the patient off the surface of the mattress and in that the supporting air film is restricted to the area of incipient contact.

Another object of the invention is to provide mechanisms locally and automatically to adjust air flow to provide uniformly adequate life regardless of the size, shape, thickness or position of supported objects such as bodies or parts of bodies.

The descriptions herein are intended to apply to the applications of the membrane, herein characterized as the upper "wall," in any of its many uses and applications.

Other objects of the invention are to provide such an air mattress characterized by low weight and simplicity of construction and operation.

There is provided in accordance with the present invention, an air pressure mattress including elastic upper and lower main support walls interconnected at a multiplicity of points by internal flexible ties that restrain separation of the main support walls by the air pressure within the mattress, the mattress being characterized in that the upper wall is locally conformable to adjacent portions of a recumbent patient and comprises an outer layer of limited stretchability and having a multiplicity of similar perforations and an inner layer substantially continuously adherent to the outer layer and of greater stretchability than the outer layer such that the neutral stretchability plane defined by the outer and inner layers lies within the outer layer, the inner layer having a separate slit in registry with each perforation of said outer layer to provide a thin film of air for lifting the patient at any regions where changes in curvature occur in connection with supporting the patient free of contact with the outer layer.

The perforations are circular in the preferred embodiment and the slits are oriented in various directions avoiding small patterns which will favor particular directions of stretch. This maximizes the uniformity of air escape to form uniform films.

In the alternative embodiment, elongation of the perforations in the outer layer, with the slits centered and oriented at 90° to the long axis of the elongated holes increases the curvature induced opening of the slits. Both the cuts and the elongated holes are variously oriented.

Since the slits are variously oriented they open in response to curvature in any direction as is necessary since the body curvature occurs in many directions and changes with every change in body position.

It should be noted that a large number of slits are contemplated for example a reasonable number and variously oriented slits in the area affected to enable sufficient air to flow under the small area of a heel. Heels are particularly vulnerable to decubitis.

With the air cushion lightly inflated, any incipient contact of a recumbent body with the upper wall imposes a negative (downward or concave) curvature of the adjacent areas of the upper wall. This curvature stretches the inner layer more than the outer layer, opening the slits in the inner layer and allowing air flow streams to be interposed in supporting relation between the upper wall and the recumbent body, the air streams, in effect, acting to lower that area of the upper wall so that it is no longer in contact with the recumbent body.

Thus, as a further feature, the air cushion of the present invention is extremely conformable with the shape of the body members in psuedo-contact (or near contact) therewith. Because only those slits underlying the body surfaces open, very small volumes and velocities of air are required to accomplish the supporting function. This, in turn, results in little noise being generated by the escaping air.

In accordance with a more particular aspect of the invention, the flexible ties are attached at points spaced between the slits. Such results in a slight positive (upward) curvature of the upper wall in the regions between the ties, imposed by the internal air pressure. Such configuration compresses the inner layer against the outer layer, thereby more tightly closing the slits so that no air escapes therefrom.

Other features and advantages of the invention will be apparent from the following description and claims, and are illustrated in the accompanying drawings which show structure embodying preferred features of the present invention and the principles thereof, and what is now considered to be the best mode in which to apply these principles.

BRIEF DESCRIPTION OF THE DRAWINGS

In the accompanying drawings forming a part of the specification and in which like numerals are employed to designate like parts throughout the same;

FIG. 1 is an elevational view illustrating the air pad (mattress) of the present invention being used in conjunction with a conventional bed to support a patient;

FIG. 2 is a fragmentary top plan view of the air pad showing a typical arrangement of perforations and slits in its upper wall;

FIG. 3 is an enlarged fragmentary sectional view taken, as indicated, along the lines 3—3 of FIG. 2;

FIG. 4 is a more detailed fragmentary sectional view showing a typical perforation and registering slit in a concave (negative) region of the upper wall of the air pad;

FIG. 5 is a fragmentary top plan view showing the perforation and slit of FIG. 4; and FIG. 6 and 7 are views similar to FIGS. 4 and 5 and showing an alternative embodiment using a different configuration.

DETAILED DESCRIPTION

With reference to FIG. 1 there is illustrated a conventional hospital bed 1 comprising a frame 2 with a mattress 3 supported thereby. A patient 4 is shown supported above conventional mattress 3 by an air pad 5 constructed in accordance with the present invention. As best shown in FIGS. 2 and 3, the air pad or mattress 5 comprises upper and lower elastic walls 8 and 9 which are joined together by a circumambient flexible sidewall 10 so as to jointly form an air pad or bag. Typically, the bag is slightly inflated and may have a total thickness of about 4 or more inches. A source of compressed air 7 is connected to the bag by means of a manifold tube 6 to be controlled in any conventional way for recharging the air in the bag to a predetermined positive air pressure.

The upper elastic wall 8 includes an outer layer 11 of slightly stretchable material such as rubber, and having a thickness of approximately 1/100 of an inch. Numerous perforations 16, preferably round holes, are of about ⅛ inch diameter. The upper elastic wall 8 further includes an inner layer 12 of extremely stretchable material, such as gum rubber completely bonded to the outer layer. The inner layer 12 is also of a thickness of approximately 1/100 of an inch and is continuously bonded to the outer layer 11. In the preferred arrangements, the thickness and stretchability relationships of the layers 11 and 12 are such that the neutral stretchability plane P lies well within the outer layer as shown in FIG. 4.

A plurality of slits 17, oriented at various angles with respect to each other, are cut through the inner layer 12 and are located in registry with the perforations 16 in the outer layer 11, there being one slit 17 for each perforation. Typically, there are 13 or more perforations and corresponding slits per square inch. Flexible ties 15 interconnect the upper and lower elastic walls 8 and 9 at points spaced between the slits of the inner layer 12. Between the ties 15, slight positive curvature of the upper wall is imposed by the internal air pressure as shown in FIG. 3. This action compresses the inner layer by the upwardly curving of the outer layer, tending thereby to more tightly close the slits 17. Attachment of the ties to the inner layer of the upper wall may require covering one or several slits which would then be incapable of exhalation. Positive curvature is maintained between the ties. No air escapes until negative curvature is produced by pseudo-contact.

With reference to FIGS. 4 and 5, when the air mattress is inflated any contact of a patient's body with the upper wall will tend to impose a negative curvature (concave) to the adjacent areas of the upper wall. This concave configuration tends to cause stretching of the inner layer 12 to an extent greater than that of the outer layer 11, thereby opening the slits 17 in the inner layer and allowing air flow to form a thin film of air to be interposed between the upper wall 8 and the corresponding region of the recumbent body.

The pressure of the resulting film of air is just sufficient to prevent further contact with the body. No matter what the position of the patient, or what surfaces of the body are presented to the upper wall of the mattress, the product of pressure of the air film multiplied by the area of induced negative curvature (concave) will support the portions of the body causing the negative curvature; therefore the whole body will be supported by the film without permitting direct contact.

As the upper wall 8 recedes, the portion of the body being so supported sinks further into the elastic membrane reversing the curvature of larger areas of the membrane and releasing air streams from the slits in these areas until equilibrium is reached. In assuming a lower position, other areas of the body may come into pseudo-contact until the entire body is supported by the various air films.

Considering the thickest parts of the body with the patient lying on the side, the vertical thickness is approximately eighteen inches. Its density is approximately that of water. Disregarding the effects of tension in the upper wall, less than one pound per square inch of air pressure in a bag without openings would comfortably support the body. With the openings of my invention approximately two pounds of air pressure is sufficient to eliminate contact of the body with the mattress. Since only those cuts adjacent to the body surfaces open, very small volumes and velocities of air are required. Little noise is generated by the escaping air.

In the mattress of this invention, the degree to which each slit is opened, and therefore the amount of air emerging therefrom is a direct function of the unit weight and curvature of the body member superior to it, resulting from the vertical column, one unit in area, of the body directly above it. On the other hand, an arm would not depress the surface as much as a buttock, a smaller area would be rendered concave and the total volume of air escaping in the area lessened. This is a self correcting situation, air being applied only where, and in the amounts required. The results include low noise, low pressure and little air.

Since all the air streams, films or cushions formed are derived from the common plenum of the mattress or pad there is little variation in the character of said cushions whether a portion of the body is in shallow or deep penetration of the mattress or pad space. Hence there is little tendency to force the body into any conformation other than that determined by the internal structure and tensions within the body. This adds positional comfort to the comfort provided by the lack of contact with surfaces.

This invention also provides several advantages, other than lack of contact, over water beds. Neglecting the tensional effects, the unit pressure exerted by a water bed is a direct function of the depth to which portions of the body sink below the highest point of its upper membrane. Hence much more unit pressure is exerted on hip or shoulder of a body lying on its side thereby forcing that member upward into an unnatural and uncomfortable conformation. Also, since the density of the air contained in the air mattress is orders of magnitude less than that of water no "sloshing" could be observed.

It should be appreciated that in the transition zone adjacent negatively curved portions of the air mattress, where the curvature changes from negative to positive, air from slits in such areas is not required because the air film created by escaping air in the lower portions of the concavity is moving outwardly and across these areas which thereby tends to maintain the required lift. Thus there results a conservation of air within the air cushion and a tendency to allow back pressure from the frictional forces to filter out fluctuations which may otherwise result in fluttering of the lips of the slits and of the transition zones.

Mattresses in present use have relatively non-conformable surfaces. The pressure of these surfaces beneath protruding parts of the body such as hips, buttocks, shoulders and heels often far exceeds the systolic blood pressure even in hypertensive persons. This, like the cuff of a sphygmanometer, cuts off the flow of blood in nearby arteries, veins and capillaries and of the lymph. When continued for extended times decubitus and gangrene result. This invention requires air pressures of one tenth to one fifth of these pressures and therefore does not restrict the free flow of blood and lymph.

Several forms of slits other than straight come to mind and allow somewhat easier opening. If cut at an angle to vertical, cut in a slight arc, or in a slightly "s" shape, they should be useful.

An alternative embodiment is shown in FIGS. 6 and 7 and is characterized by elongation of the perforations 20 (oval holes) with the slits or cuts 21 centered and oriented at 90° to the long axis. This arrangement increases the curvature induced opening of the slits. In a total mattress array both the holes 20 and slits 21 are variously oriented.

The lower wall may be constructed of any nonporous material. However for various reasons reversability may be desirable. if so, the lower wall may be constructed in the same manner as the upper wall.

From the foregoing it will be apparent that only a relatively low level of positive pressure need be maintained within the air pad 5 to produce the required air stream velocity for lifting the recumbent patient relative to the upper elastic wall 8. Such is due to the fact that air can escape from the air pad only through those slits in the regions of negative deformation caused by the presence of a portion of a recumbent body.

For therapeutic reasons, oxygen or other gases may be substituted for air. An example would be to supply oxygen to an oxygen tent arrangement by means of an air support pillow or mattress.

What is claimed is:

1. A membrane composed of a first layer of thin, flexible material of limited stretchability and having a multiplicity of similar perforations and a second layer of thin, flexible material substantially continuously adherent to the first layer and of greater stretchability than the first layer such that the neutral plane of stretchability-compressability defined by said first and second layer lies within the first layer, and said second layer having a separate slit in registry with each perforation in said first layer.

2. A support pad comprising a membrane as described in claim 1 sealed at its periphery to a mating impermeable membrane and means for introducing air between the membranes to inflate the pad.

3. A membrane as described in claim 1 sealed to a mating impermeable membrane to define a chamber and means for introducing oxygen between the membranes to inflate the chamber.

4. An air pressure support including elastic upper and lower main support walls interconnected at a multiplicity of points by internal flexible ties that restrain separation of the main support walls by the air pressure within the support and means for introducing air between the walls to inflate the support being characterized in that the upper wall is locally conformable to overlying portions of a recumbent patient and comprises an outer layer of limited stretchability and having a multiplicity of similar perforations and an inner layer substantially continuously adherent to the outer layer and of greater stretchability than the outer layer such that the neutral stretchability plane defined by said outer and inner layers lies within the outer layer, said inner layer having a separate slit in registry with each perforation of said outer layer to provide air flow films for lifting the patient at any regions where changes in shape occur in connection with supporting the patient free of contact with the outer layer.

5. An air pressure support as defined in claim 4 and wherein said perforations are round holes and said slits are oriented in various directions.

6. An air pressure support as defined in claim 4 and wherein said perforations are oval holes oriented in various directions and each of said slits is central of its holes and extends at 90° thereto.

7. An air pressure support as defined in claim 4 wherein the mattress is slightly inflated to provide portions of convex curvature intermediate the ties such that the inner layer and its slit region are positively biased upwardly in normally sealing relation against the outer layer.

8. An air pressure support as defined in claim 7 and wherein said perforations are round holes and said slits are oriented in various directions.

9. An air pressure support as defined in claim 7 and wherein said perforations are oval holes oriented in various directions and each of said slits is central of its hole and extends at 90° thereto.

10. A membrane as defined in claim 1, each said separate slit being closed to prevent fluid passage therethrough in the absence of a condition of negative curvature of the immediately adjacent region of said second layer, each said separate slit being open to permit fluid passage therethrough when said region of said second layer is in said condition of negative curvature.

11. A support pad as defined in claim 2 and wherein said perforations are round holes and said slits are oriented in various directions.

12. A support pad as defined in claim 2 and wherein said perforations are oval holes oriented in various directions and each of said slits is central of its holes and extends at 90° thereto.

* * * * *